US005884350A

United States Patent [19]

Kurze

[11] Patent Number: 5,884,350

[45] Date of Patent: Mar. 23, 1999

[54] PROCESS AND DEVICE FOR PLACING A PATIENT IN THE CORRECT POSITION FOR TREATMENT

[75] Inventor: Ulrich Kurze, München, Germany

[73] Assignee: Sirona Dental Systems GmbH & Co. KG, Bensheim, Germany

[21] Appl. No.: 815,758

[22] Filed: Mar. 12, 1997

Related U.S. Application Data

[63] Continuation of Ser. No. 338,576, filed as PCT/EP93/01236 May 18, 1993 published as WO93/23003 Nov. 25, 1993, abandoned.

[30] Foreign Application Priority Data

May 18, 1992 [DE] Germany ..... 42 16 424-9
Mar. 2, 1993 [DE] Germany ..... 43 06 466.3

[51] Int. Cl.[6] ..... A61G 15/12

[52] U.S. Cl. ..... 5/600; 5/613; 297/330; 297/408

[58] Field of Search ..... 5/600, 613, 614, 5/616, 624; 297/217.3, 330, 406, 408

[56] References Cited

U.S. PATENT DOCUMENTS

| | | | |
|---|---|---|---|
| 4,128,797 | 12/1978 | Murata | 297/330 X |
| 4,168,099 | 9/1979 | Jacobs et al. | 5/614 X |
| 4,435,862 | 3/1984 | King et al. | 5/616 X |
| 4,769,584 | 9/1988 | Irigoyen et al. | 5/616 X |
| 5,015,035 | 5/1991 | Stoeckl et al. | 297/330 X |
| 5,190,349 | 3/1993 | Austin, Jr. et al. | 297/330 X |
| 5,203,609 | 4/1993 | Stoeckl | 297/330 X |
| 5,214,360 | 5/1993 | Gonser et al. | 297/330 X |
| 5,484,188 | 1/1996 | Stoeckl | 297/408 |

FOREIGN PATENT DOCUMENTS

| | | |
|---|---|---|
| 0 491 085 | 6/1992 | European Pat. Off. . |
| 2 025 585 | 12/1971 | Germany . |
| 2 119 837 | 11/1972 | Germany . |
| 3 032 693 | 5/1982 | Germany . |
| 3 611 406 | 7/1987 | Germany . |

*Primary Examiner*—Michael F. Trettel
*Attorney, Agent, or Firm*—McDermott, Will & Emery

[57] ABSTRACT

This invention relates to the supporting of a patient in a proper position for a treatment, particularly for a dental and/or orosurgical and/or orthodontic treatment. A patient to be treated is supported in a certain position on a treating chair or a treating couch (1) and the treating chair or the treating couch (1) moves that region in which the patient is to be treated, particularly the tooth or jaw region, to a spatial position which is defined by the height of the treating physician and which has previously been stored for a given treating physician or is stored by the treating physician. In dependence on previously determined stored parameters that region in which the patient is to be treated is located at that spatial position for different treatments, particularly of the tooth and/or jaw regions.

29 Claims, 3 Drawing Sheets

PROCESS AND DEVICE FOR PLACING A PATIENT IN THE CORRECT POSITION FOR TREATMENT

This application is a continuation of application Ser. No. 08/338,576, filed as PCT/EP93/01236, May 18, 1993, published as WO93/23003, Nov. 25, 1993, abandoned.

BACKGROUND OF THE INVENTION

1. Field of the Invention

This invention relates to a method and apparatus for supporting a patient in a proper position for a treatment, particularly for a dental and/or orosurgical and/or orthodontic treatment.

2. Description of Related Art

In the treatment of patients in the medical field, particularly in the field of dental medicine, the position of the physician, particularly of the dentist, and the position of the patient are of high importance. For an optimum result of the treatment it is important that those regions of the patient which are to be treated are optimally accessible to the physician and possibly to an assistant; for this reason it is usual for a dental or orosurgical treatment to support the patient in a certain position on a treating chair or treating couch. Owing to the different spatial positions of those tooth surfaces or jaw regions which are to be treated, the adjustment of the patient in the optimum position for the treatment may be time-consuming and complicated. Besides, the posture of the physician will be of essential significance for the ergonomy and, as a result, for his or her personal stress during the treatment.

German Patent Specification 21 19 837 describes a program-controlled chair for dental treatment, in which any manually adjustable position of the chair can be transferred by transfer means to a memory. In the use of that chair for dental treatment it is possible to a store positions which have been adjusted during a treatment on the storage medium and to retrieve said positions subsequently for the same treatment. For this reason it is possible to correctly reposition a patient for the same treatment very quickly in dependence on the stored data. But for a treatment of other regions it is necessary to adjust the chair to an entirely new position.

German Patent Specification 36 11 406 describes a station for dental treatment, in the use of which control data for a plurality of treating instruments and associated position control elements are stored in a portable data memory, which can be inserted into a memory receptacle, and control data can be written into said data memory and can be retrieved from it, inter alia, during a subsequent treatment, when said memory is in said receptacle. That data memory preferably contains data which are specific to a given patient and also permits a positioning of the patient only in previously adjusted positions.

Whereas particularly during a dental or orosurgical treatment those regions of the patient which are to be treated can systematically be determined as regards the orientation of different tooth surfaces, it is not possible in the use of the previously known treating chairs or treating couches to use data which are specific to a patient and to the physician for an adjustment of the treating chair or treating couch when new regions of the patient are to be treated. For any additional new treatment of the same patient it is necessary to re-determine and adjust the treating chair or treating couch to that position which is ergonomically most favorable for the treatment.

SUMMARY OF THE INVENTION

For this reason it is an object of the invention to simplify the adjustment of a treating chair or treating couch to a position which is ergonomically most favorable for a given treating physician in the treatment of a specific region in which the patient is to be treated.

In the method the object is accomplished in that a patient to be treated is positioned in a specific position on a treating chair or a treating couch and the treating chair or treating couch moves a region in which the patient is to be treated, particularly the dental or jaw region, to a spatial position which is defined by the height of the treating physician and which has previously been stored for the treating physician or which is stored by the treating physician, and in that defined spatial position the orientation of that region in which the patient is to be treated is adjusted in dependence on predetermined stored parameters for each of different treatments, particularly of the tooth and jaw regions.

In an apparatus comprising a treating chair or a treating couch, position control elements attached to said chair or couch, and means for controlling the position control elements, which means comprise at least an input unit, a microprocessor, a memory and an output unit, which memory is adapted to store in association with each other data of the position control elements for different positions and orientations of the treating chair or of the treating couch for a given treating physician and a region in which a patient is to be treated, which data have previously been stored and/or can be entered by the input unit and can be output and/or read in via the output unit from a data carrier.

In that context the term "spatial position" determines absolute coordinates in space independently of the treating chair and independently of the movements of the treating chair and of the patient. The "defined spatial position" is that location in space to which the region is moved in which the patient is to be treated. With reference to that location, the term "orientation" indicates an angular position in space, e.g., the angular position or inclination of tooth surfaces, during the treatment or during the movement to the optimum position for the treatment.

The elevation of the defined spatial position of a given region in which the patient is to be treated desirably corresponds approximately to the elevation of the underarm of the treating physician when that underarm extends from the body of the physician at an angle of about 90° whereas his or her upper arm lies against the trunk of the physician.

During the movement of the patient to the position for the treatment the head of the patient is desirably in an inclined position, which is defined by a movable headrest, which is attached to the treating chair or treating couch. An excessive inclination or tilting of the trunk of the patient can thus also be avoided.

The spatial position and orientation of that region in which the patient is to be treated can be adjusted or can be adjusted more accurately without a need for time-consuming further adjustments to be effected by the treating person or physician if measured parameters, particularly the weight or height of the patient, are detected by measuring sensors and the detected parameters are associated with predetermined positions, to which the treating chair or treating couch is subsequently moved.

The influence of the physician can be taken into account in that the defined spatial position for a given treating physician is determined in that the measuring sensors detect the height of the treating physician and use said height for a calculation of the defined spatial position.

The influence of the patient can be taken into account in that the patient occupies the treating chair or treating couch and respective parameters of the patient are then detected by measuring sensors, which are provided on the treating chair or treating couch and particularly consist of instruments for measuring weight or pressure or an instrument for measuring length.

The height of the patient can be detected in that the length over which the headrest is displaced is measured.

The parameters may be detected by the measuring sensors in that measuring sensors which are spaced from the treating chair or treating couch, particularly an instrument for measuring weight or length, detect the weight or height of the patient before he or she occupies the treating chair or treating couch. As the patient is about to occupy the chair or couch, the corresponding data of the patient can be calculated so that they are already available at the beginning of the treatment.

If the measured values are detected as the patient or the treating physician moving to the treating chair or treating couch traverses a light barrier or a distance-measuring instrument and/or moves over weighing means provided in the floor, the corresponding parameters of the patient and/or the physician can be detected independently of the treating chair or treating couch.

The accuracy of the position of the treating chair and/or the treating couch can further be improved in that the position of that region in which the patient is to be treated, particularly of his or her tooth or jaw regions, is adjusted or is still more accurately adjusted by the treating chair or treating couch in that further parameters of the patient are detected by a direct measurement of the spatial position and/or of the spatial dimensions of the region which is to be treated and are compared with previously stored values of prescribed positions and the patient is moved to a position which corresponds to the predetermined stored position.

The direct measurement of the spatial position and/or the spatial dimensions of that region in which the patient is to be treated is desirably effected in that a distance-measuring instrument measures the position of the maxillary arch and/or mandibular arch or the position of the soft tissues which cover the maxillary or mandibular arch or the position of the teeth of the maxillary or mandibular arch.

A distance-measuring instrument which can be manipulated simply comprises a camera, which is to be moved to or into the oral cavity of the patient and which has preferably a wide-angle lens, the spatial position of that camera is detected and evaluated and the camera optically detects the position of the jaw arches and/or the position of the teeth and said optically detected position is evaluated.

Another distance-measuring instrument which is also non-contacting and for this reason complies with more stringent hygienic requirements detects the spatial position and/or the spatial dimensions of that region in which the patient is to be treated. To that end the spatial echos of the sound from one or more ultrasonic generators which are disposed near the region in which the patient is to be treated are detected by at least two ultrasonic receivers and is or are subsequently evaluated.

The same advantages will be afforded if the spatial position and/or the spatial dimensions of that region in which the patient is to be treated is or are measured in that the shadow of the patient, preferably the lateral and the frontal shadows of the head of the patient, or the spatial reflections by the patient of the light from one or more light sources disposed near that region in which the patient is to be treated, is or are detected and subsequently evaluated, particularly by a camera and/or a plurality of photovoltaic cells.

The subsequent data processing can be simplified and moire techniques can be used if the light sources project patterns on that region in which the patient is to be treated and said patterns are evaluated by the camera or the photovoltaic cell. The patterns are particularly generated by one or more parallel laser beams, which preferably have wavelengths in an invisible range and are moved over that region in which the patient is to be treated.

The measurement of the spatial position and/or spatial dimensions of that region in which the patient is to be treated can be further simplified in that the spatial reflections of light from a bite-on plate held by the patient with his or her teeth or his or her jaw or from a reflecting and preferably fluorescent layer which has been applied to the lips of the patient are detected and are subsequently evaluated by a camera and/or a plurality of photovoltaic cells.

It has been found that it is ergonomically desirable for the treating physician to hold during a change of the position of the patient that region which is to be treated, particularly the tooth and/or jaw regions, substantially stationary in the defined spatial position.

The change of the position of the patient may be effected quickly and in a manner which is pleasing for the patient if the position control elements of the treating chair or treating couch are actuated in such a coordination that only a simple position control movement is imparted by a given position control element so that the treating chair or treating couch performs only a single position control movement from a previous position to a new position and those position control elements which are actuated at a time are actuated substantially during the same time.

The work of the treating physician can further be alleviated in that light marks which indicate the optimum location of the treating physician are projected on the floor beside the treating chair or treating couch and the light marks particularly indicate a larger surface area in which the feet of the treating physician are required to stand, or the light marks directly indicate the prescribed positions of the feet of the treating physician, or said position is indicated by luminous means attached to the treating chair and/or treating couch. The optimum location of the treating physician is indicated in accordance with the hour-indicating positions of a pointer on a dial, see also the accompanying FIG. 3. Light marks for similar purposes are provided for the assistant on her side.

The physician will still have his or her hands free for the treatment and will comply with hygienic requirements if the instructions for the operation, particularly the positioning and the orientation of the treating chair or treating couch, are given by voice and are received by a microphone and delivered to a voice recognition and output unit. Besides, the voice control will eliminate the need for a starting pedal for controlling the treating instruments. As a result, a turning of the pelvis of the treating person is desirably avoided because it is no longer necessary for the treating person to move his or her foot. The voice control which is provided may be used for all units which are required in connection with the treatment and such units particularly include also laser instruments and $AlO_3$ jet-producing implements. The instruments and means which can be positioned by voice control particularly include a conventional motor-driven truck for supporting instruments, a saliva sucker, and a funnel for spit-out saliva. Just as the treating chair the means mentioned last are desired to be positioned under voice control to a position which is specific to the patient and the treating person.

The positioning of the treating chair or treating couch can be improved in that categories of patients to be treated, such as "man, woman, child, tall, medium, short" can be stored in the memory of the apparatus and data which are associated with said categories and serve to control the position control elements for moving the treating chair or treating couch to different positions may previously be stored in the memory of the apparatus.

The means for projecting light marks are desirably arranged in a base region or foot region of the treating chair or treating couch because space which is required for the treatment will not be occupied in that case. Alternatively or in addition a row of light-emittion diodes for indicating the correct dial position may desirably be provided at the outer edge of the treating chair or treating couch.

The work of the treating physician can further be facilitated in that a work-illuminating lamp can be controlled by voice input via the input unit or the microprocessor. Just as the treating chair or treating couch the work-illuminating lamp is so programmed that a voice input designating a given tooth and tooth surface will result in a specific positioning of the work-illuminating lamp. The measuring sensor consisting of an integrated fixed camera is preferably also incorporated in the work-illuminating lamp.

It will also be desirable to maintain the supported patient in the proper position for the treatment even when the patient has changed his or her position. To that end the treating chair is repositioned automatically and/or under voice control, preferably with the aid of the camera.

Additional optical control means are provided between the treating person and the treating chair and serve to automatically reposition the treating chair in response to a change of the dial position of the treating person.

The invention will now specifically be described with reference the figures, in which

Figure 6B:
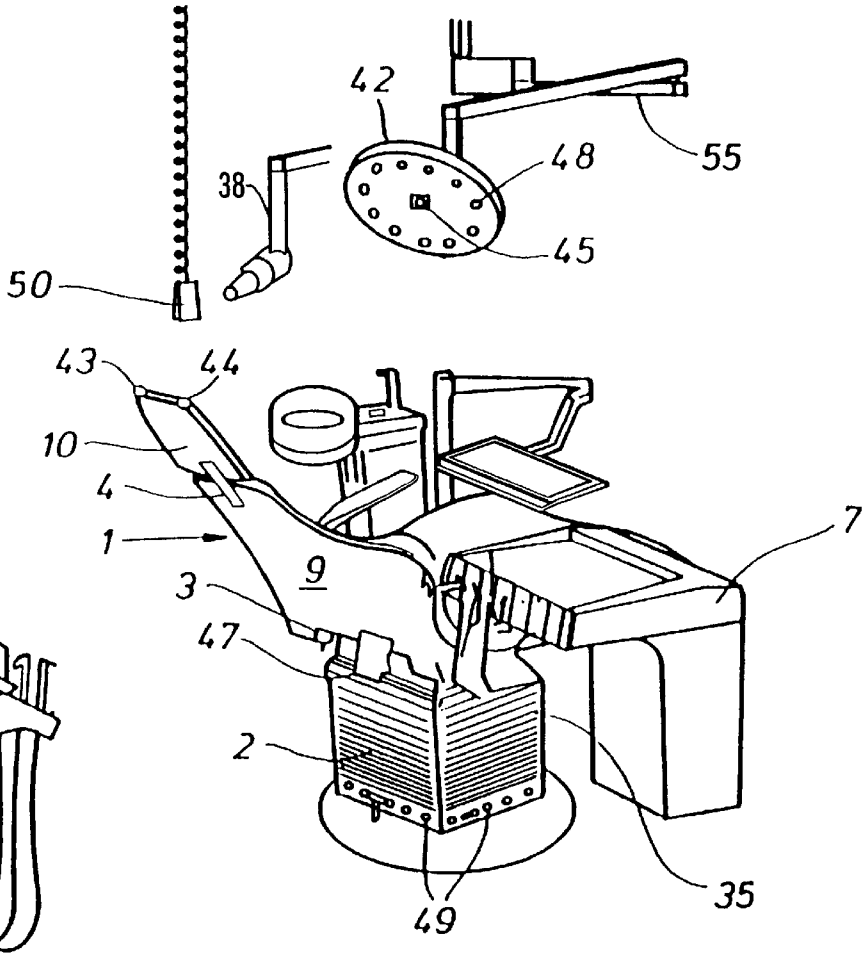
FIGS. 6A and 6B are elevations showing a treating station and the associated elements of the apparatus in accordance with the invention.
Figure 6A:
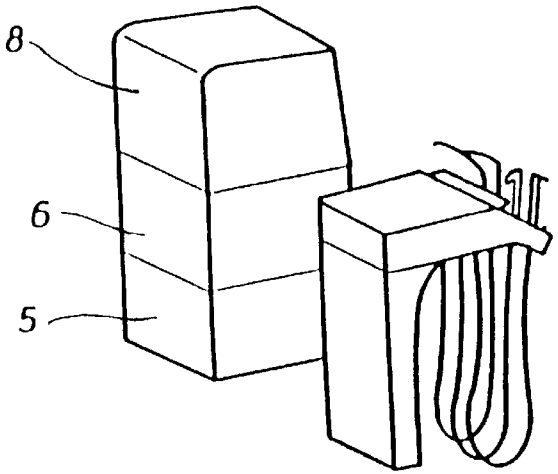

The apparatus will first be described with reference to FIG. 6.

DESCRIPTION OF THE PREFERRED EMBODIMENTS

The apparatus essentially comprises a treating chair 1 and position control elements 2, 3, 4, which are attached to said chair and are shown here only by way of example, and means 5 for controlling the position control elements 2, 3, 4. Said means for controlling comprise an input unit 6, 7, an output unit 8, a memory for storing fixed and variable data, and a microprocessor.

The means 5 for controlling the position control elements 2, 3, 4 are connected in known manner to the actuators for actuating the position control elements 2, 3, 4 so that said actuators are controlled by the means 5 for controlling or can be adjusted by a manual actuation of the respective position control elements 2, 3, 4.

The position control elements 2, 3, 4 which are shown here and serve to adjust the inclination of the backrest 9 and the headrest 10 and the height of the treating chair 1 have been selected by way of example for a simplified representation of any further position control elements.

The means 5 for controlling can be operated by means of an input unit 6 and an input unit 7 and are adapted to deliver and to read in data in known manner via an output unit 8 and for this purpose use known data carriers, such as floppy disks, magnetic cards, memory chips or punched cards.

The memory of the means 5 for controlling is adapted to store data which are associated with the physician and which indicate the optimum spatial position for a given physician. Data which are specific to the patient, such as the weight or height, can also be stored, and standardized data for the regions to be treated have permanently been stored before.

Figure 5:
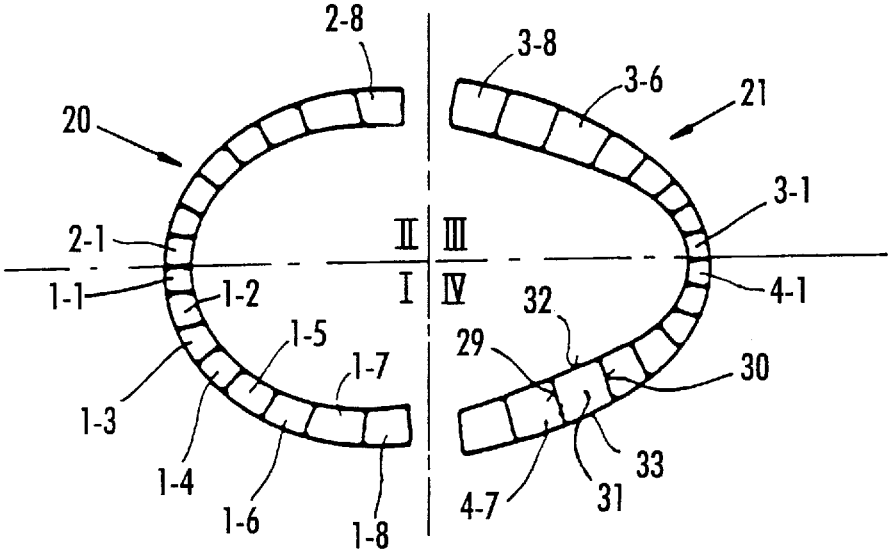
FIG. 5 shows a division of the upper and lower tooth arches into segments and additional surface designations.

The regions to be treated are divided into segments as is indicated in FIG. 5. The upper tooth arch 20 and the lower tooth arch 21 are respectively divided into tooth positions, such as the tooth positions 12, 13, 14, 15, 16, 17, 18, which correspond to the normal desired positions of the teeth of the patient. Tooth surfaces 29, 30, 31, 32, 33 (distal, medial, occlusal, oral, vestibular surfaces) are associated with each tooth and have been stored before. Specific positions of the treating chair 1 are associated with said tooth surfaces.

Categories of patients to be treated, such as "man, woman, child, tall, medium, short" are also stored in the camera and either correspond to a separate set of data of adjusted positions of the treating chair 1 which are associated with respective tooth surfaces, or scaling factors for the change of the adjusted positions of the treating chair 1.

A tooth surface, such as "oral, vestibular, distal, mesial, occlusal" is also associated with the tooth position so that the voice control which will be described hereinafter can associate commands given by voice input with the adjusted positions of the treating chair in dependence on the division into segments.

Measuring sensors are connected to the means 5 for controlling and detecting the weight and/or height of the patient and/or the physician and deliver said information to the means 5 for controlling.

Said measuring sensors are so attached to the treating chair 1 that the height of the patient is detected in that the adjusted position of the headrest 10 is detected and converted or the weight is detected by weighing means incorporated in the base 35 of the treating chair 1.

In embodiments in which the headrest 10 cannot be longitudinally adjusted the position of the head of the patient and with it the height of the patient can be detected in that contacts or pressure sensors for detecting the position of the head of the patient are arranged in the headrest 10 itself.

Alternatively, the measuring sensors may be arranged near the treating chair 1 in the region in which the treating chair 1 is accessible and in that case consist of one or more light barriers, which is or are used in known manner as a distance-measuring instrument. The weighing means are arranged near the floor.

Further measuring sensors for detecting the position of that region in which the patient is to be treated, particularly the tooth or jaw regions, are provided near the treating chair 1 and are so connected to the means 5 for controlling that data related to the spatial position of that region which has been detected by the measuring sensor can be stored in the memory 5 of the means for controlling.

The measuring sensor consists of a camera 38, which comprises units for detecting its spatial position and units for evaluating the spatial position of the images which have been recorded by the camera 38. The camera 38 is provided with a wide-angle lens, which owing to its large angle of view records an image of the upper and l tooth arches 20, 21. The evaluating units communicate with the means 5 for controlling.

Alternatively, one or more ultrasonic generators 43 and one or more ultrasonic receivers 44 may be arranged near the treating chair 1.

Light sources for illuminating the region to be treated are alternatively or additionally arranged near the treating chair 1 or in the work-illuminating lamp 42 and another camera 45 and/or photovoltaic cells 46 is or are arranged near the headrest 10 and is or are connected to an evaluating unit, which like the above described evaluating unit delivers the data to the means 5 for controlling.

Alternatively, one of the light sources consists of a laser light source which has a low emissive power and emits in the range of invisible wavelengths and generates line or grid patterns, particularly dot patterns. For deflecting the laser beam a unit is provided which comprises movable deflecting elements for moving the beam over the region to be treated and only the data of the gridlike dot patterns are scanned in a simple manner in the camera 45 and are decoded with reference to the position of the region to be treated.

Means 47 for projecting light marks are provided adjacent to the base 35 of the treating chair 1 and with the means 5 for controlling the optimum locations of the treating physician and optionally of an assistant are determined in the means 5 for controlling in dependence on the data stored in the memory of the means 5 for controlling. Specifically, a larger surface area is indicated, in which the feet of the treating physician or of the assistant are required to stand, or the position prescribed for the feet of the treating physician or of the assistant are directly indicated by the light marks. Alternatively, luminous means 49 mounted on the base 35 of the treating chair 1 are lighted to directly indicate that location.

A microphone 50 is provided near the treating chair 1 and is fixed either to a boom or to a microphone tripod or is freely suspended from the ceiling. The microphone is connected to an evaluating unit for voice recognition and the evaluating unit communicates with the means 5 for controlling 50 that instructions which have been detected from a voice input by the microphone 50 can be decoded by the evaluating unit and are delivered to the means 5 for controlling, in which they are associated with the adjusted positions of the treating chair 1.

The work-illuminating lamp 42 is mounted on a boom 55, which is provided with position control elements, which are not shown and for their actuation are connected to the means 5 for controlling.

The boom 55 of the work-illuminating lamp 42 and the intensity and functions of the distance-measuring instruments mounted on the work-illuminating lamp 42 can be controlled by the means 5 for controlling in such a manner that commands given by voice input will produce the corresponding effects, such as "brighter, darker, closer, higher, lower, left, right", or commands may be performed which have been given via the input units 6, 7. One of said commands may indicate, e.g., the tooth position together with the tooth surface. Just as the treating chair 1 the work-illuminating lamp 42 is so programmed that the voice input indicating a tooth and a tooth surface will also effect a control of the position of the work-indicating lamp 42, and as mentioned hereinbefore, the work-indicating lamp 42 may also include the measuring sensor consisting of a fixedly integrated camera 45.

The treating chair 1 is pivotally movable not only in the vertical direction but also in a transverse direction manually and by actuators which are actuated by the means 5 for controlling. The treating chair 1 comprises above its backrest 9 a headrest 10, which is connected by a position-control element 4 to the backrest 9. About the position control element 4, which is arranged near the side of the backrest 9 and of the headrest 10, the headrest 10 is pivotally movable laterally and vertically by manual action and by actuators which are actuated by the means 5 for controlling.

The headrest 10 is laterally provided with contacting surfaces 11, 12, which when the headrest 10 has been pivoted to a lateral position are engageable by the head of the patient to provide a reliable and comfortable support.

Figure 1:
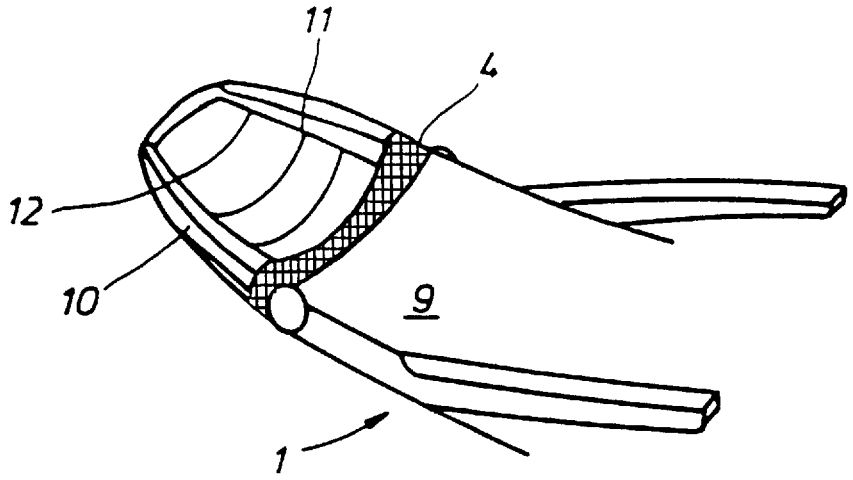
FIG. 1 is an elevation showing the upper portion of a treating chair or treating couch with a headrest which is pivoted thereto.
Figure 2:
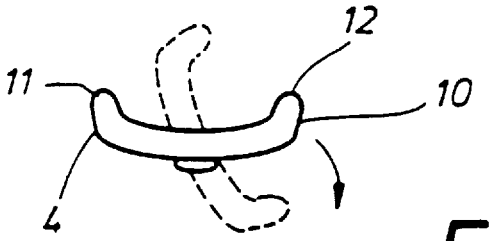
FIG. 2 is a transverse sectional view showing the headrest of the treating chair or treating couch after a pivotal movement of the headrest.
Figure 3:
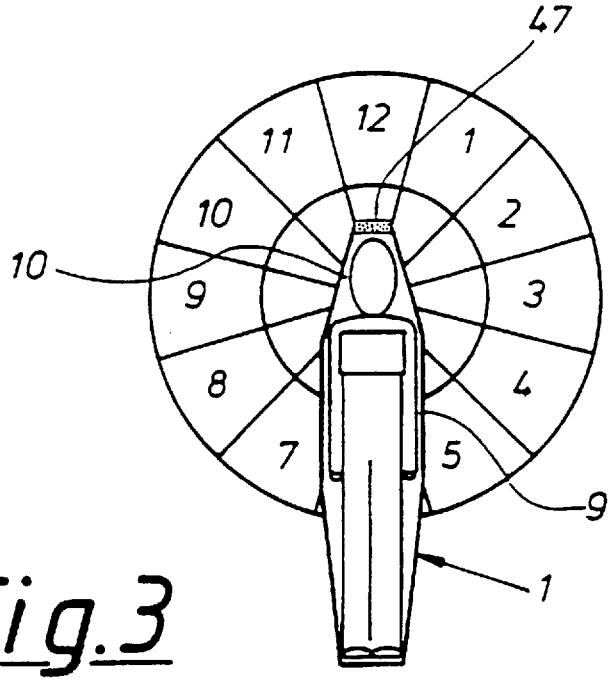
FIG. 3 is a schematic representation of a patient and of working positions which can be assumed for the treatment with referee to a dial.
Figure 4A:
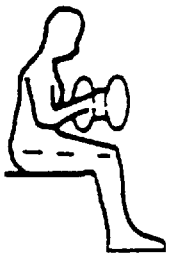
FIGS. 4A–4C shows schematic representations of a dentist and a patient during the treatment viewed from three different sides.
Figure 4B:
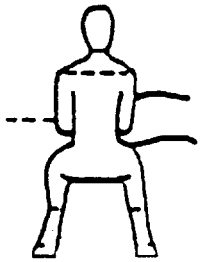
Figure 4C:
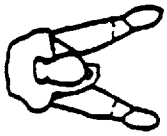

In the manner indicated in FIG. 2 the headrest 10 can be laterally pivotally moved about the position control element 4 so that the head of the patient can perform a slight tilting movement to the rear at the same time.

Within the scope of the invention the respective evaluating units and the means 5 for controlling may be constituted by distributed microprocessors mounted on the respective detecting units or the function of each evaluating means may be performed by the means 5 for controlling.

The method will be specifically described hereinafter.

In dependence on the illustrative embodiment, the data of the patient, such as his or her height or weight, are detected before the beginning of the treatment by the measuring sensors which are disposed near the treating couch, or, when the patient occupies the treating chair 1 the data which are specific to the patient are detected by the measuring sensors which are provided on the treating chair 1.

The data which are specific to a given treating position are delivered to the means 5 for controlling by the input units 6, 7 or by the measuring sensors or by voice input via the microphone 50 or from a data carrier via the output unit 8.

When the patient occupies the treating chair 1, the treating physician defines via the input units 6, 7 or by voice input that region in which the patient is to be treated. By means of a movable camera the two tooth arches are recorded just as for a photographically controlled mold-making process and are represented and stored in a simplified form as a tooth arch. The height of the tooth is extrapolated at the same time and a division into segments is effected in dependence thereon so that missing teeth will not give rise to a problem. The internal measurement is similar to a measurement for orthodontic purposes. Because the two tooth arches are stored in the memory, the front portion will be sufficient for the intended positioning. The measuring sensor, in the present case preferably the camera 45 which is integrated in the work-illuminating lamp 42, should be centrally incorporated.

A possible sequence of commands given by voice input consists of the commands "position control, four-six, vestibular". The command "position control" given by voice input is a signal for initiating the following sequence of commands. A light signal, not shown, may preferably indicate the readiness to receive. This will avoid a change of the position of the treating chair 1 in response to word combinations occurring during conversation.

The number "four-six" indicates the position of the tooth 4-6 in FIG. 5 in accordance with the previously described division into segments, and the attribute "vestibular" indicates the tooth surface 33.

If there is no tooth at a given tooth position or if tooth positions have been changed by a migration of teeth, the number of the corresponding normal tooth position will be indicated so that the position of the treating chair 1 will correctly be controlled in that case too.

When the command has been entered, that region in which the patient seated or lying on the treating chair 1 is to be treated is moved to the spatial position which is defined by the height of the treating physician and is in dependence on the previously stored standardized parameters the treating chair 1 is adjusted to such a position that the region to be treated has the correct orientation. If the patient is supported in a lying position for a treatment of his upper jaw, the programmed end position is desirably not assumed in a continuous movement but at least one interruption is effected. This remark is applicable only to a movement from a sitting to a lying position and will be applicable to all patients who confirm that they are ready to assume a lying position but cannot estimate the extent of the required movement.

In an embodiment of the invention there may be no measuring sensors for detecting data which are specific to the patient. In that case the treating physician will enter features, such as "man, woman, child, tall, medium, short" so that the position of the treating chair 1 will be more accurately controlled.

In a further embodiment of the invention the position can still more accurately be controlled in that the position of that region in which the patient is to be treated and/or further parameters of the patient are detected by a direct measurement of the spatial position and/or the spatial dimensions of the region to be treated and is or are compared with previously stored values of prescribed positions and the patient is moved to a predetermined stored position which corresponds to the prescribed position.

Arbitrary as well as non-arbitrary movement performed by the patient during the treatment are compensated in that case in that the actual position of that region in which the patient is to be treated is detected and a compensation is effected by a movement which is opposite to the movement of the patient.

The direct measurement of the spatial position and/or the spatial dimensions of that region in which the patient is to be treated is effected in that a distance-measuring instrument measures the position of the maxillary and/or mandibular arches or tooth arches 20, 21 or the position of soft tissues which cover the maxillary or mandibular arch or the position of the teeth of the maxillary or mandibular arch.

If the camera 38 is used, it will be moved by the treating physician to the oral cavity of the patient and in response to a signal given by the physician and transmitted by the previously described input units 6, 7, 50 or by a pushbutton provided on the camera 38 the spatial position of the camera 38 will be detected and said optically detected position will be evaluated and delivered to the means 5 for controlling.

Alternatively, the spatial position and/or the spatial dimensions of that region in which the patient is to be treated is or are detected by ultrasonic generators 43 in cooperation with ultrasonic receivers 44, which are disposed near that region in which the patient is to be treated.

In further illustrative embodiments of the invention said data may be acquisitioned in that the shadow of the patient, preferably the lateral and frontal shadows of the head, or spatial reflections by the head of the light from the light sources are detected by the camera 45 or the photovoltaic cells 46 and are subsequently evaluated. In a further illustrative embodiment the patterns which have been projected on that region in which the patient is to be treated by the light source, which preferably consists of a laser light source, are evaluated by the camera 45 or by the photovoltaic cells 46. In that case the patterns are generated by one or more parallel laser beams, which have wavelengths in an invisible range and have a low emissive energy and are moved over that region in which the patient is to be treated.

According to a further feature, non-moving directed dots, which are spatially fixed, are projected on that region in which the patient is to be treated and the position of said dots is evaluated by the camera 45.

Alternatively, the direct measurement of the spatial position and/or the spatial dimensions of that region in which the patient is to be treated is effected in that the spatial reflections of light on a bite-on plate held by the patient with his or her teeth or jaw or on a reflecting and fluorescent layer applied to the lips of the patient are detected and are subsequently evaluated by a camera 45 or the photovoltaic cell 46.

An optical or acoustic indication may preferably be provided to indicate to the treating person that and to what extent a patient has substantially moved from his or her adjusted position. In that case the treating person can simply effect a correction by a voice command. Alternatively, the provided camera can be used to maintain the intended optimum position for the treatment in that a repositioning is automatically initiated when the patient has moved from that position.

For taking X-rays, the positioning program desirably provides for spatial supporting positions of the treating chair 1 and said positions may also be readjusted by the voice control which is provided. For the repositioning the microphone is usefully carried around the neck to hang near the sternum. In that case it is desirable that in addition to the function proper of the microphone an optical registration with the light strip or luminous means 49 on the treating chair 1 can be effected by a so-called sternum lamp. In that case it is possible, e.g., by a voice command, to optically effect an automatic control of the position of the treating chair in response to a changed new dial position assumed by the treating person.

The position of the supported patient can be individually corrected freely without a recorrection by the program, for instance, when the patient is retching because liquid has accumulated or amalgam particles have fallen on the soft palate. For the intended facilitation of the adjustment to the position which is most favorable for the treatment it is decisive not only to move the tooth surface to a fixed point in space but also to adjust the surface to be treated to the correct angular position with respect to the tooth axis/tooth arch. On the other hand, the significance of a small jaw/tooth arch and a large jaw/tooth arch and its effects must be taken into account. For instance, the tooth 1-6 of a small jaw is disposed on the level of 1-4/1-5 of large jaw/tooth arch. For this reason it is important for the intended programming to detect also the size of the tooth arch.

When the treatment has been terminated the sequence of commands described hereinbefore may be given for another region which is to be treated. If only the tooth surface is changed in that case, the voice input "position control, occlusal" will be sufficient and those parameters which have not been changed, such as the position of the tooth in the lower or upper jaw, will be upheld.

The command will result in a corresponding change of the adjusted position of the treating chair 1 and of the position of the patient but the region which is to be treated will remain substantially stationary in the spatial position which has been defined.

During the change of the position the position control elements 2, 3, 4 of the treating chair 1 are actuated with such a coordination that a given position control element will perform only a single position control movement so that the treating chair 1 will perform only a single position control movement from its previous position to a new position and all position control elements 2, 3, 4 which are actuated at a time will be actuated substantially during the same time.

During the treatment, the treating physician and any assistant is or are furnished with light marks, which are projected on the floor beside the treating chair 1 and indicate an optimum location for the treatment. Specifically, either a large surface area is indicated in which the feet of the treating physician or of the assistant are required to stand or the prescribed position of the feet of the treating physician or of the assistant may be directly indicated by the light marks or said location may be indicated by lighting means 49 mounted on the treating chair. That location is determined in dependence on the previously described dial position with reference to the sternum of the patient.

When the treatment has been terminated a simple command can be entered to move the treating chair 1 to its initial position, in which the chair can be occupied and left.

I claim:

1. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments.

2. A method according to claim 1, characterized in that the spatial position of that region in which the patient is to be treated corresponds approximately to an elevation of the underarm of the treating physician when the underarm extends from the body of the physician at an angle of about 90° whereas the upper arm of the physician lies against the trunk of the physician.

3. A method according to claim 1, characterized in that during movement of the patient to the position for the treatment, the head of the patient is vertically and laterally inclined to a position defined by a headrest, which is attached to the treating chair and is movable and provided with a concentric cushion, which is soft-hard from inside to outside.

4. A method for supporting a patient in a proper position for a treatment, according to claim 1, further comprising the step of adjusting the orientation of the region in which the patient is to be treated by detecting at least one of the spatial position and spatial dimensions of the region which is to be treated and comparing the detected at least one of the spatial position and the spatial dimensions with previously stored values of prescribed positions and moving the patient to a position which corresponds to one of the prescribed positions.

5. A method according to claim 1, characterized in that the region which is to be treated remains substantially stationary in the spatial position during a change of a position of the patient.

6. A method according to claim 5, characterized in that position control elements of the treating chair are actuated such that only a simple position control movement is imparted by a given position control element so that the treating chair performs only a single position control movement from a previous position to a new position and the actuated position control elements are actuated during substantially the same time.

7. A method according to claim 1, characterized in that instructions for operation of the treating chair are given by voice and received by a microphone and delivered to a voice recognition and output unit.

8. A method for supporting a patient in a proper position for a treatment, according to claim 1, further comprising adjusting the spatial position and the orientation of the region in which the patient is to be treated, by detecting at least one of a weight parameter and a height parameter of the patient, the detected at least one parameter being associated with predetermined positions of the treating chair, and the treating chair is subsequently moved to one if said predetermined positions.

9. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments further comprising adjusting the spatial position and the orientation of the region in which the patient is to be treated by detecting at least one of a weight parameter and a height parameter of the patient, the detected at least one parameter being associated with predetermined positions of the treating chair, and the treating chair is subsequently moved to one of said predetermined positions;

characterized in that the spatial position to which the region is moved is determined by detecting the height of the treating physician and selecting the stored spatial position in dependence on said detected height.

10. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments further comprising adjusting the spatial position and the orientation of the region in which the patient is to be treated by detecting at least one of a weight parameter and a height parameter of the patient, the detected at least one parameter being associated with predetermined positions of the treating chair, and the treating chair is subsequently moved to one of said predetermined positions;

characterized in that the at least one parameter of the patient is detected by sensors disposed on the treating chair for measuring at least one of a weight and a pressure when the patient occupies the treating chair.

11. A method according to claim 6, characterized in that a height of the patient is detected by sensing a position of the head of the patient on a headrest of the treating chair.

12. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments further comprising adjusting the spatial position and the orientation of the region in which the patient is to be treated by detecting at least one of a weight parameter and a height parameter of the patient, the detected at least one parameter being associated with predetermined positions of the treating chair, and the treating chair is subsequently moved to one of said predetermined positions;

characterized in that the at least one parameter is detected by sensors which are spaced from the treating chair for measuring weight and length of the patient before the patient occupies the treating chair.

13. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments;

further comprising the step of adjusting the orientation of the region in which the patient is to be treated by detecting at least one of the spatial position and spatial dimensions of the region which is to be treated and comparing the detected at least one of the spatial position and the spatial dimensions with previously stored values of prescribed positions and moving the patient to a position which corresponds to one of the prescribed positions;

characterized in that the at least one of the spatial position and the spatial dimensions of the region in which the patient is to be treated is detected by a distance-measuring instrument which measures a position of a maxillary arch and mandibular arch.

14. A method according to claim 13, characterized in that the distance-measuring instrument includes a camera, which is moved towards an oral cavity of the patient and has a wide-angle lens and the camera optically detects the position of the jaw arches, and the at least one of the spatial position and the spacial dimensions is detected by detecting a spatial position of the camera and evaluating the detected spatial position and said optically detected position.

15. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments;

further comprising the step of adjusting the orientation of the region in which the patient is to be treated by detecting at least one of the spatial position and spatial dimensions of the region which is to be treated and comparing the detecting at least one of the spatial position and the spatial dimensions with previously stored values of prescribed positions and moving the patient to a position which corresponds to one of the prescribed positions;

characterized in that the at least one of the spatial position and the spatial dimensions of the region in which the patient is to be treated is detected by detecting spatial reflections of light from one of a bite-on plate held by teeth of the patient and a reflecting fluorescent layer applied to the lips of the patient and subsequently evaluating the detected spatial reflection with at least one of a camera and a plurality of photovoltaic cells.

16. A method for supporting a patient in a proper position for treatment, comprising the steps of:

positioning a patient to be treated in a specific position on a treating chair; and moving the treating chair to move a region in which the patient is to be treated to a stored spatial position which is defined by the height of the treating physician;

wherein in said spatial position, the orientation of the region in which the patient is to be treated is adjusted in dependence on predetermined stored parameters for each of different treatments;

further comprising the step of indicating an optimum location of the treating physician by one of light marks projected on a floor beside the treating chair indicating a surface area of the floor in which the treating physician is required to stand, and luminous means attached to the treating chair in a dial position indicating an area in which the treating physician is required to stand with reference to a sternum.

17. An apparatus for supporting a patient in a proper position for a treatment, comprising:

a treating chair;

position control elements attached to said chair; and means for controlling the position control elements, including at least an input unit, a microprocessor and a memory, wherein (i) the memory is adapted to store, in association with each other, data of the position control elements for different positions and orientations of the treating chair for at least one measured body parameter of a given treating physician and a region in which a patient is to be treated, (ii) the data is one of previously stored data and inputted data entered by the input unit, and (iii) the microprocessor is adapted to process the data to control said position control elements in accordance with said data.

18. An apparatus according to claim 17, characterized in that a microphone which is connected to the means for controlling the position control elements and instructions entered by voice input are adapted to be decoded and forwarded to the means for controlling.

19. An apparatus according to claim 17, further comprising:

dental instruments and means which are adapted to be controlled by the microprocessor, wherein the dental instruments and means include a work-illuminating lamp.

20. An apparatus for supporting a patient in a proper position for a treatment, comprising:

a treating chair;

position control elements attached to said chair; and means for controlling the position control elements, including at least an input unit, a microprocessor and a memory, wherein (i) the memory is adapted to store, in association with each other, data of the position control elements for different positions and orientations of the treating chair for a given treating physician and a region in which a patient is to be treated, (ii) the data is one of previously stored data and inputted data entered by the input unit, and (iii) the microprocessor is adapted to process the data to control said position control elements in accordance with said data;

further comprising:

sensors for detecting one of a weight and a height of one of a patient and a physician, which are connected to the means for controlling the position control elements, wherein data detected by the sensor are adapted to be stored in the memory.

21. An apparatus according to claim 20, characterized in that the sensors are attached to the treating chair and include a sensor for measuring the height of one of the patient and the physician which is attached to means for longitudinal adjustment of a headrest of the treating chair.

22. An apparatus according to claim 20, characterized in that the sensors are arranged near the treating chair, in a region from which the treating chair is accessible, and include one of a light barrier and a distance-measuring instrument and weighing means arranged adjacent to the floor.

23. An apparatus for supporting a patient in a proper position for a treatment, comprising:

a treating chair;

position control elements attached to said chair; and means for controlling the position control elements, including at least an input unit, a microprocessor and a memory, wherein (i) the memory is adapted to store, in association with each other, data of the position control elements for different positions and orientations of the treating chair for a given treating physician and a region in which a patient is to be treated, (ii) the data is one of previously stored data and inputted data entered by the input unit, and (iii) the microprocessor is adapted to process the data to control said position control elements in accordance with said data;

further comprising sensors for detecting the position of the region in which the patient is to be treated arranged near the treating chair and connected to the means for controlling the position control elements wherein data concerning a spatial position of the region which are detected by the sensors are adapted to be stored in the memory.

24. An apparatus according to claim 23, characterized in that the sensors for detecting the position of the region to be treated include a camera, having a wide-angle lens, connected to the means for controlling the position control elements.

25. An apparatus according to claim 23, further comprising:

one or more ultrasonic generators and one or more ultrasonic receivers arranged near the treating chair and connected to the means for controlling the position control elements.

26. An apparatus according to claim 23, further comprising:

light sources which illuminate the region to be treated and arranged near the treating chair, and at least one of a camera and photovoltaic cells arranged near a headrest of the treating chair which are connected to the means for controlling the position control element.

27. An apparatus for supporting a patient in a proper position for a treatment, comprising:

a treating chair;

position control elements attached to said chair; and means for controlling the position control elements, including at least an input unit, a microprocessor and a memory, wherein (i) the memory is adapted to store, in association with each other, data of the position control elements for different positions and orientations of the treating chair for a given treating physician and a region in which a patient is to be treated, (ii) the data is one of previously stored data and inputted data entered by the input unit, and (iii) the microprocessor is adapted to process the data to control said position control elements in accordance with said data;

further comprising:

means for projecting light marks disposed near the treating chair and said means communicate with the means for controlling the position control elements and are adapted to project light marks on a floor in dependence on data which concern a spatial position and orientation of the treating chair stored in the memory.

28. An apparatus for supporting a patient in a proper position for a treatment, comprising:

a treating chair;

position control elements attached to said chair; and means for controlling the position control elements, including at least an input unit, a microprocessor and a memory, wherein (i) the memory is adapted to store, in association with each other, data of the position control elements for different positions and orientations of the treating chair for a given treating physician and a region in which a patient is to be treated, (ii) the data is one of previously stored data and inputted data entered by the input unit, and (iii) the microprocessor is adapted to process the data to control said position control elements in accordance with said data;

further comprising:

means for repositioning the treating chair with the aid of a camera in order to maintain the patient in a proper position for treatment if a position is changed by the patient.

29. An apparatus for supporting a patient in a proper position for a treatment, comprising:

a treating chair;

position control elements attached to said chair; and means for controlling the position control elements, including at least an input unit, a microprocessor and a memory, wherein (i) the memory is adapted to store, in association with each other, data of the position control elements for different positions and orientations of the treating chair for a given treating physician and a region in which a patient is to be treated, (ii) the data is one of previously stored data and inputted data entered by the input unit, and (iii) the microprocessor is adapted to process the data to control said position control elements in accordance with said data;

further comprising:

optical control means disposed between the treating physician and the treating chair and adapted to automatically re-align the treating chair when the treating person has changed positions.

* * * * *